United States Patent [19]

Eckert

[11] Patent Number: 4,972,619

[45] Date of Patent: Nov. 27, 1990

[54] RIFLE SIGHTING APPARATUS

[76] Inventor: Kenneth I. Eckert, 82 McComb St., New Philadelphia, Pa. 17959

[21] Appl. No.: 443,001

[22] Filed: Nov. 29, 1989

[51] Int. Cl.[5] ..... E41A 27/14

[52] U.S. Cl. ..... 42/94; 89/37.04

[58] Field of Search ..... 42/94; 89/37.04

[56] References Cited

U.S. PATENT DOCUMENTS

| | | | |
|---|---|---|---|
| 4,026,057 | 5/1977 | Cady | 42/94 |
| 4,055,017 | 10/1977 | Thompson | 42/94 |
| 4,077,554 | 3/1978 | Goode | 224/42.46 R |
| 4,438,581 | 3/1984 | Lavalle | 42/94 |
| 4,548,392 | 10/1985 | Rickling | 269/156 |
| 4,558,531 | 12/1985 | Kilby | 42/94 |
| 4,799,324 | 1/1989 | Nodo | 42/94 |

OTHER PUBLICATIONS

J. Wayne Fears, Bald Eagle Front Rifle Rest, 2/89, p. 73.

Taylor & Robbins, The American Rifleman, 4/57, pp. 16–19.

*Primary Examiner*—Charles T. Jordan
*Assistant Examiner*—Rochelle Lieberman
*Attorney, Agent, or Firm*—Leon Gilden

[57] ABSTRACT

An apparatus is set forth comprising a first base member spaced from a second base member, wherein the first base member includes plural pairs of foot members including elastomeric surfaces to support the first base member, wherein the first base member includes a forwardly positioned hinge housing to hingedly receive a pivot platform thereon adjacent a forward edge of the pivot platform. The pivot platform includes a rear edge with a second hinge housing coextensive with the rear edge of the pivot platform. A "V" shaped support is pivotally mounted to the second hinge housing with an upper hook mounted to the "V" shaped support, and a lower hook supported adjacent a rear edge of the first platform, with a turnbuckle threadedly receiving threaded ends of the upper and lower hooks to vertically reposition the "V" shaped support. The rear support includes a "U" shaped mount including a resilient cushion laminated therewithin to receive a butt stock portion of an associated rifle. A modification of the instant invention includes the rear platform defined by a planar support enclosed about three sides thereof to receive a "T" shaped elastomeric insert with a preconfigured ellipsoidal cavity therewithin to enable interchanging of the "T" shaped inserts dependent upon gun stock configurations. The modification includes the rear platform and forward platform secured together by spaced parallel rails to enable spatial adjustment of the forward platform relative to the rear platform.

7 Claims, 4 Drawing Sheets

PRIOR ART 34
12a
33
35
31
32
41
40
36
37
38
10a
39
11
25
28
27
14
37a

RIFLE SIGHTING APPARATUS

BACKGROUND OF THE INVENTION

1. Field of the Invention

The field of invention relates to rifle sighting apparatus, and more particularly pertains to a new and improved rifle sighting apparatus wherein the sam provides for rapid and accurate adjustment of a rifle mounted within the apparatus.

2. Description of the Prior Art

During various shooting events, it is essential that the sighting of the associated firearm, such as a rifle, be particularly compatible with an individual sighting and shooting through that rifle. The testing of rifles for accuracy and the like also requires that subsequent to adjustment of rifle sights relative to an individual, testing accuracy of a rifle relative to particular ballistics related to ammunition requires that an associated fire arm be readily adjustable and fixed relative to a target to eliminate parameters of shooter error in testinG of various ammunition relative to a particular firearm. There have been many efforts within the prior art to develop a rifle sighting apparatus wherein the same provides for positioning of a rifle during a shooting event. An example of the prior art device may be found in U.S. Pat. No. 4,055,017 to Thompson wherein a mounting base is pivotally mounted to a support, with a forward concave rest securing a forward portion of the associated rifle with a rear insert positionable relative to the apparatus to receive a rear portion of the rifle. The Thompson patent fails to provide the multi-adjustment adaptability of the instant invention in accommodating a variety of firearms thereon.

U.S. Pat. No. 4,438,581 to LaValle sets forth an adjustable support for use with handguns, wherein a forwardly positioned yoke receives a handgun with a generally "L" shaped rear support for resting of a pistol butt thereon.

U.S. Pat. No. 4,799,324 to Nodo sets forth a unitary, horizontal platform formed with a forward support and a rear recoil support for securing a rifle thereon during a firing procedure. The rear recoil support is formed of a flexible material to engage the rear portion of a pistol or rifle positioned within the apparatus.

U.S. Pat. No. 4,077,554 to Goode sets forth a window mounted rack organization provided with spaced supports with clamped pairs mounted on each support for securing elongate articles therewithin, such as skis.

U.S. Pat. No. 4,026,057 to Cady sets forth a rifle support wherein a plurality of spaced, open-topped cradles receive a rifle therewithin, wherein the forward cradle is pivotal to an upwardly oriented position and adjustable to accommodate a rifle compensating for an uneven slope or terrain mounting the apparatus.

As such, it may be appreciated that there is a continuing need for a ne and improved rifle sighting apparatus wherein the same addresses both the problems of ease of use, as well as effectiveness in the construction and securement of a rifle therein, and in this respect, the present invention substantially fulfills this need.

SUMMARY OF THE INVENTION

In view of the foregoing disadvantages inherent in the known types of rifle supporting apparatus now present in the prior art, the present invention provides a rifle sighting apparatus wherein the same adjustably accommodates in a recoil absorbing manner a rifle particularly during a shooting procedure. As such, the general purpose of the present invention, which will be described subsequently in greater detail, is to provide a new and improved rifle sighting apparatus which has all the advantages of the prior art rifle support apparatus and none of the disadvantages.

To attain this, the rifle sighting arrangement includes an apparatus comprising a first base member spaced from a second base member, wherein the first base member includes plural pairs of foot members including elastomeric surfaces to support the first base member, wherein the first base member includes a forwardly positioned hinge housing to hingedly receive a pivot platform thereon adjacent forward edge of the pivot platform. The pivot platform includes a rear edge with a second hinge housing coextensive with the rear edge of the pivot platform. A "v" shaped support is pivotally mounted to the second hinge housing with an upper hook mounted to the "V" shaped support, and a lower hook supported adjacent a rear edge of the first platform, with a turnbuckle threadedly receiving threaded ends of the upper and lower hooks to vertically reposition the "V" shaped support. The rear support includes a "U" shaped mount including a resilient cushion laminted therewithin to receive a butt stock portion of an associated rifle. A modification of the instant invention includes the rear platform defined by a planar support enclosed about three sides thereof to receive a "T" shaped elastomeric insert with a preconfigured ellipsoidal cavity therewithin to enable interchanging of the "T" shaped inserts dependent upon gun stock configurations. The modification includes the rear platform and forward platform secured together by spaced parallel rails to enable spatial adjustment of the forward platform relative to the rear platform.

My invention resides not in any one of these features per se, but rather in the particular combination of all of &hem herein disclosed and claimed and it is distinguished from the prior art in this particular combination of all of its structures for the functions specified.

There has thus been outlined, rather broadly, the more important feature of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rifle sighting apparatus which has all the advantages of the prior art rifle support apparatus and none of the disadvantages.

It is another object of the present invention to provide a new and improved rifle sighting apparatus which may he easily and efficiently manufactured and marketed.

It is a further object of the present invention to provide a new and improved rifle sighting apparatus which is of a durable and reliable construction.

An even further object of the present invention is to provide a new and improved rifle sighting apparatus which is susceptible of a low cost of manufacture with regard to both materials and labor, and which accordingly is then susceptible of low prices of sale to the consuming public, thereby making such rifle sighting apparatus economically available to the buying public.

Still yet another object of the present invention is to provide a new and improved rifle sighting apparatus which provides in the apparatuses and methods of the prior art some of the advantages thereof, while simultaneously overcoming some of the disadvantages normally associated therewith.

Still another object of the present invention is to provide a new and improved rifle sighting apparatus wherein the same adjustably in a spatial and angular manner supports a forward and rear portion of a rifle for use during a shooting event.

Elevational adjustments with a shooter maintaining a line of sight are provided by the instant invention with the shooter merely effecting a single hand adjusting (by rotation) of of a turnbuckle).

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic forward, exploded view of a modification of the rear support platform of the instant invention.

FIG. 7 is a top orthographic view of a modified sighting apparatus utilized by the instant invention.

DESCRIPTION OF THE PREFERRED EMBODIMENT

Figure 1:
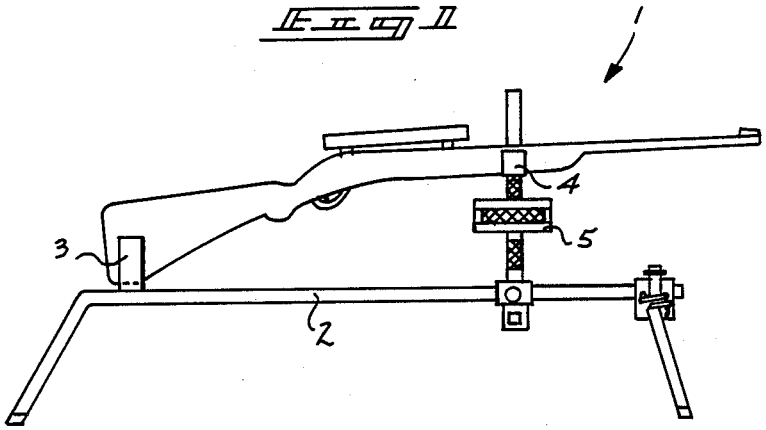
FIG. 1 is an orthographic view taken in elevation of a prior art rifle sighting apparatus.
Figure 2:
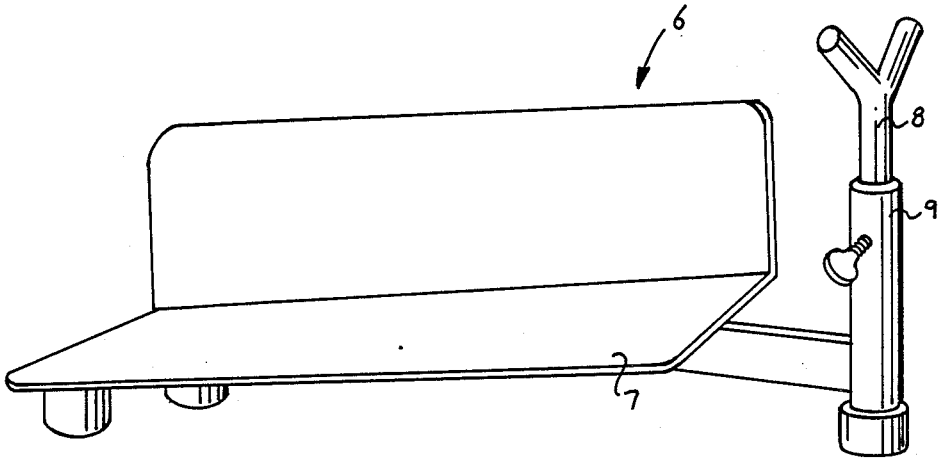
PRIOR ART Fig 2
FIG. 2 is a isometric illustration of a prior art pistol sighting apparatus.
Figure 3:
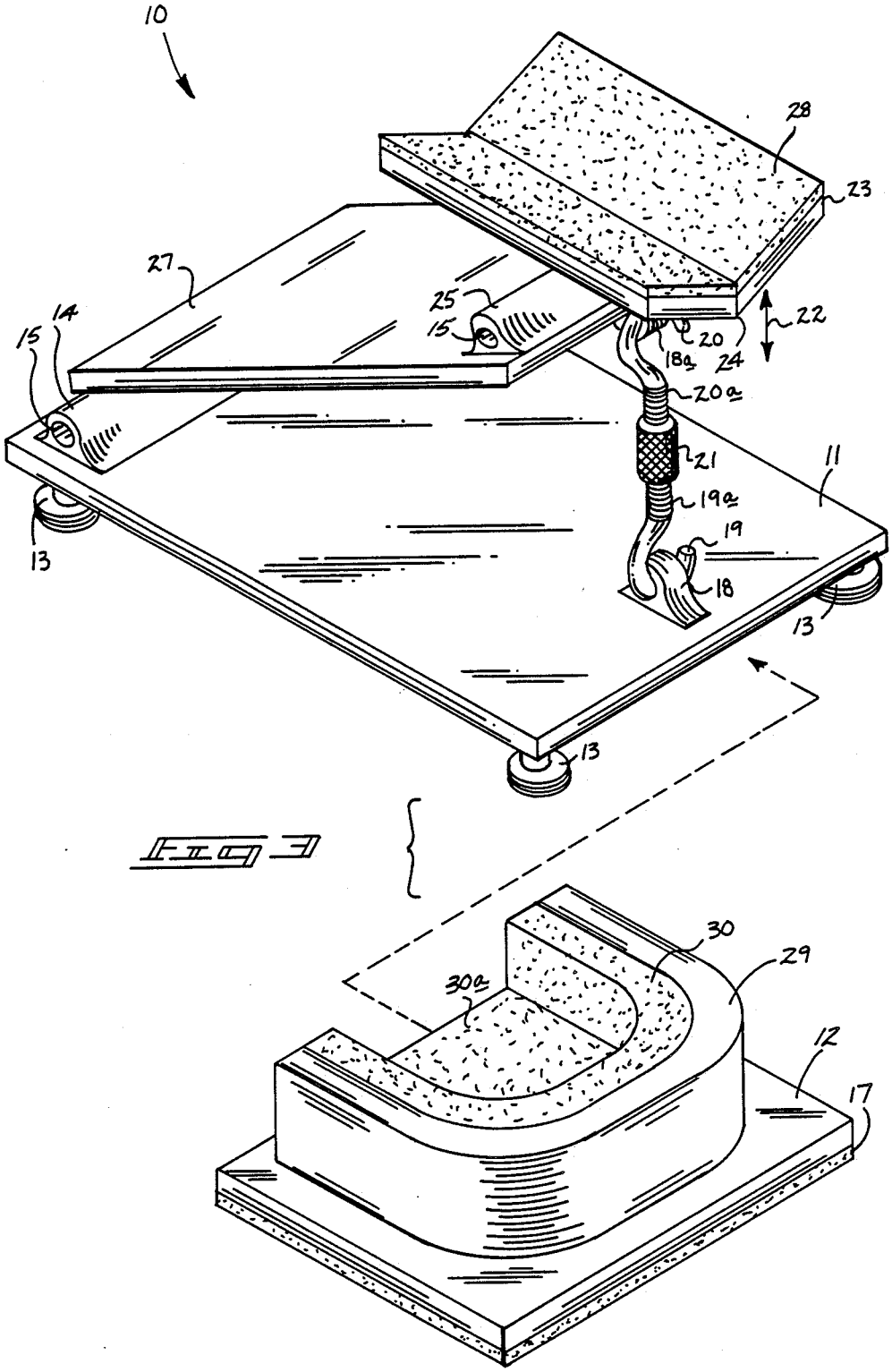
FIG. 3 is an isometric illustration of the instant invention.
Figure 4:
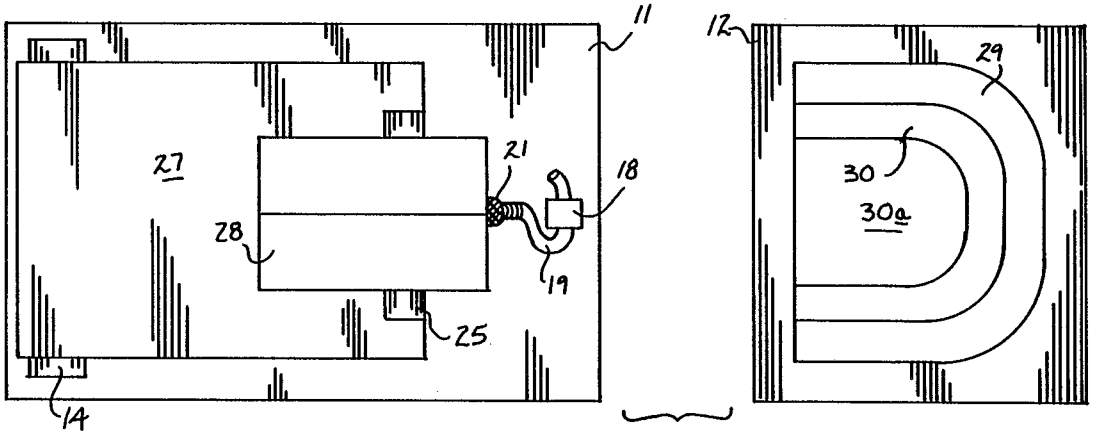
FIG. 4 is a top orthographic view of the instant invention.

With reference now to the drawings, and in particular to FIGS. 1 to 8 thereof, a new and improved rifle sighting apparatus embodying the principles and concepts of the present invention and generally designated by the reference numerals 10 and **10*a*** will be described.

FIG. 1 illustrates a rifle sighting apparatus 1 set forth in the prior art provided with a forward and rear cradle 4 and 8 respectively to receive a forward and rear portion of the rifle stock therewithin. The forward and rear cradles are mounted upon a unitary support form 2 with a pivotal forward leg and formed with the forward cradle adjustably mounted relative to the rifle stock to accommodate various terrain and support conditions. The prior art apparatus 6 illustrates a generally "L" shaped rear platform 7 for receiving a butt stock portion of a pistol thereon while mounting the forward portion of the pistol within the "Y" shaped support 8 that is adjustably and vertically received within the sleeve 9.

Figure 5:
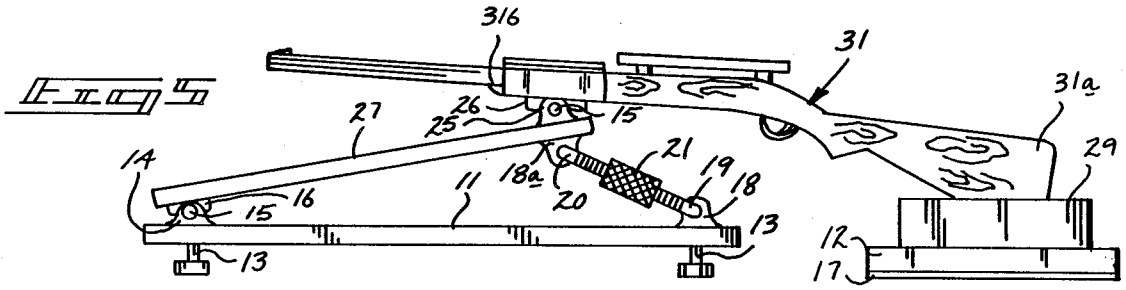
FIG. 5 is an orthographic side view of the instant invention taken in elevation.

More specifically, the rifle sighting apparatus 10 of the instant invention essentially comprises a forward first platform 11 spaced from a rear second platform 12. The first platform includes plural pairs of foot members 13 including cylindrical cushion pads orthogonally mounted to the foot members to mount the first platform 11 in a shock absorbing cushioned manner relative to a support surface. A first elongate hinge housing boss 14 is in alignment and overlying a forward pair of the cushioned feet members 13 and is adjacent a forward edge of the first platform 11. A cylindrical hinge bearing 14 is rotatably mounted within and coextensively of the housing boss 15 and is fixedly mounted to a first hinge block 16. The first hinge block 16 is integrally secured to the pivot platform 27. The pivot platform 27 includes a second hinge housing boss 25 mounting a cylindrical hinge bearing 15 therewithin that is fixedly secured to a second hinge block 26 that in turn is secured to a "V" shaped support 23. The second hinge block 26 is mounted to the elongate apex 24 of the "V" shaped support 23. A lower hook boss 18 is mounted adjacent a rear edge of the first platform 11 with an upper hook boss **18*a* fixedly mounted and medially positioned underlying the second hinge block 26 at a bottom surface of the pivot platform 27 adjacent the rear edge thereof. The lower and upper hook bosses 18 and 18*a* receive a respective lower and upper hook 20 therewithin that include respective threaded shanks 19*a* and 20*a*. An adjustable turnbuckle 21, formed with a through-extending bore, threadedly receives the respective threaded shanks 19*a* and 20*a*, wherein rotation of the turnbuckle effects pivotment of the "V" shaped support 23 in the direction of the arrow 22 about the second housing boss 25. It is noted that the "V" shaped support 23 includes a "V" shaped elastomeric sheet covering 28 thereover to receive in a cushioned manner a forward end or forestock 31*b* of a rifle stock 31, as illustrated in FIG. 5** for example.

The second or rear platform 12 is formed with a coextensive elastomeric sheet 17 laminated to a bottom surface of the platform 12 to provide a cushioned friction engaging surface to position the rear platform in a predetermined orientation relative to the forward platform or first platform 11. The second platform 12 further includes a "U" shaped support positioned medially on an upper surface of the second platform 12 with a "U" shaped elastomeric cushion 30 laminated to an interior surface of the "U" shaped support 29 with a "C" shaped elastomeric sheet covering 30*a* positioned interiorly of the "U" shaped support 29 laminated to the top surface of the second platform 12 to receive the butt stock 31*a* of the rifle stock 31 therewithin.

Figures 8, 9, 11:
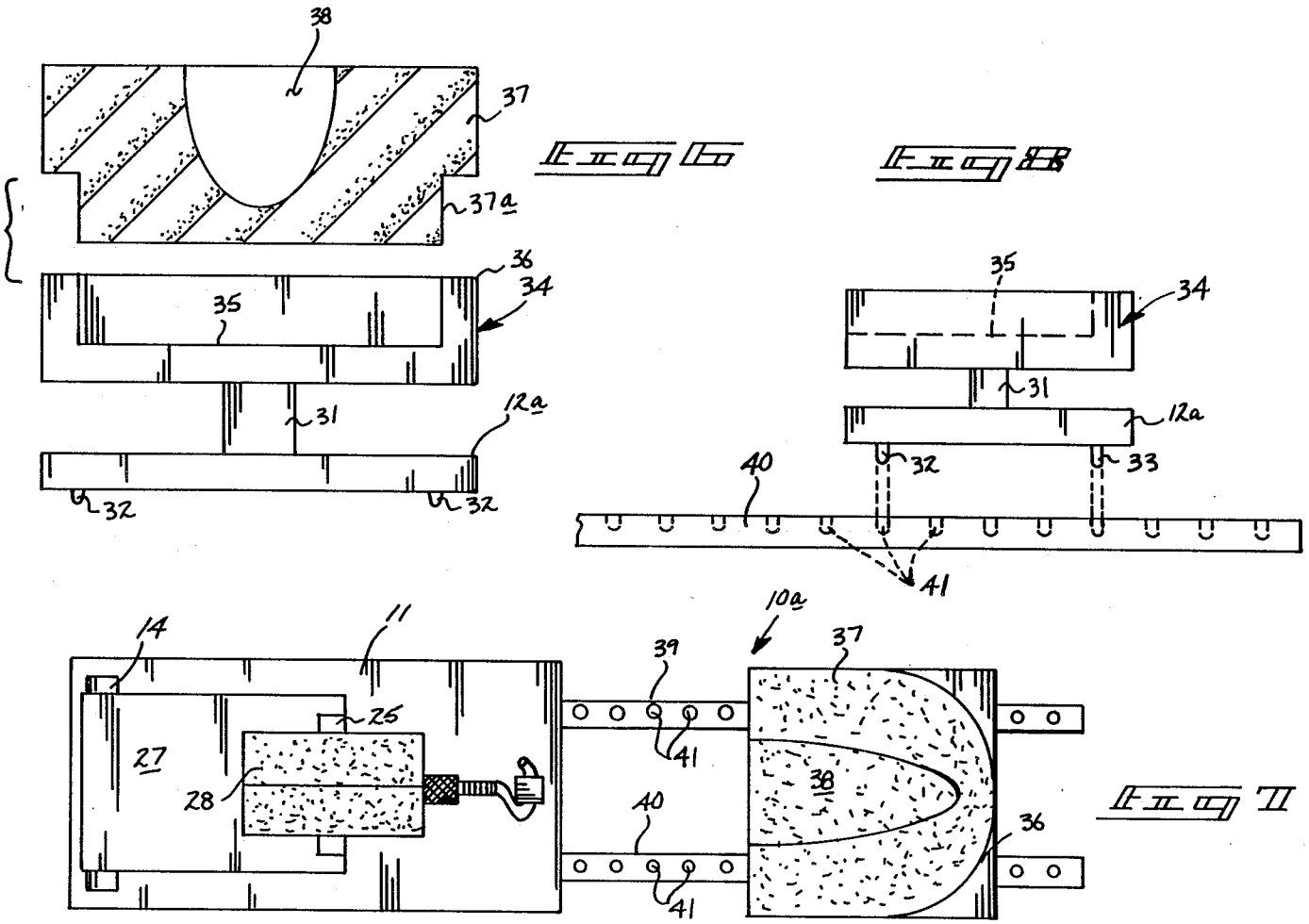
FIG. 8 is an orthographic side view taken in elevation of the rear platform in association with the rail apparatus.

Reference to FIGS. 6, 7, and 8 illustrate a modified rifle sighting apparatus 10*a* wherein the modified second platform 12*a* includes plural pairs of pegs therein comprising a forward pair of peg members 32 defined by a first spacing therebetween, as illustrated in FIG. 6 for example, with a rear pair of peg members 33 positioned rearwardly of the first pair of peg members 32, wherein the rear pair of peg members 33 are spaced relative to one another by the first spacing and are spaced rearwardly of the forward pair of peg members 32 by a second spacing defining a distance between the individual ones of the forward and rear peg members 82 and 88 respectively. A pedestal 31 mounts an insert platform 34 thereon, wherein the platform 34 comprises a support floor 35 with a surrounding "U" shaped wall 36 fixedly mounted to the side and rear edges of the support floor 35, with an opened forward end in a spaced relationship relative to the first platform 11. A "T" shaped elastomeric insert 37 is defined by a semi-ellipsoidal cavity 38 to receive the butt stock 31*a* therewithin. The "T" shaped inserts 37 are replaceably mounted within the insert platform 34 to enable various inserts 37 to accommodate various configurations of butt stocks of rifles. The "T" shaped insert 37 is defined by a recess lower wall 37*a* of a predetermined height equal to a predetermined height defined between the support floor 35 and an upper edge of the "U" shaped wall 36. A first rail 39 is fixedly mounted to the first platform 11 in a spaced parallel relationship relative to a second rail 40. The first and second rails 39 and 40 are of an equal predetermined rail length and are formed in blind bores 41, wherein each of the blind bores are of a depth equal to the defined length of each of the peg members 32 and 38. The first and second rails are spaced apart a distance defined by the first spacing, wherein each of the blind bores are spaced apart a distance equal to the second spacing and fractions thereof to provide incremental positioning of the second platform 12*a* relative to the first platform 11 engaging the pegs 32 and 33 within respective pairs of blind bores 41 to accommodate various rifle stocks 31 within the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to. falling within the scope of the invention.

What is claimed as being new and desired to be protected by LETTERS PATENT of the United States is as follows:

1. A rifle sighting apparatus comprising, in combination:

a first platform member including a pivot platform mounted thereon, the pivot platform including a first rifle support member pivotally mounted thereon, and the pivot platform adjustably mounted relative to the platform member.

and a second platform independent of and spaced from the first platform rearwardly thereof including a second support member fixedly mounted to an upper surface of the second platform member, wherein the first support member receives a forward end of a rifle and the second support member receives a rear end portion of a rifle to align the rifle between the first platform member and the second platform member, and the pivot platform includes a first hinge member mounted adjacent a forward edge of the pivot platform and a forward edge of the platform member, and the hinge member pivotally mounts the forward edge of the pivot platform to the forward edge of the member, and a second hinge member mounted adjacent a rear edge of the pivot platform and the first rifle support member mounted to the second hinge member to pivotally mount the first support member to the pivot platform adjacent the rear edge of the pivot platform, and an adjustment means mounted to the rear end of the pivot platform at an upper end of the adjustment means, and the adjustment means mounted adjacent a rear end of the platform member, and the adjustment means including an adjustment member to pivot the platform relative to the platform member.

2. An apparatus as set forth in claim 1 wherein the first support member includes a "V" shaped support, the "V" shaped support defining an elongate apex, wherein the apex is fixedly mounted to the second hinge member.

3. An apparatus as set forth in claim 2 wherein the adjustment means includes an upper hook secured to a projecting hook boss, wherein the projecting hook boss is integrally secured adjacent the rear edge of the pivot platform to a bottom surface of the pivot platform, and a lower hook secured to a lower hook boss, wherein the lower hook boss is integrally secured adjacent the rear edge of the platform member, and a rotatable turnbuckle, and the upper hook and lower hook each includes a threaded shank threadedly receivable within the turnbuckle to vary the effective length of the upper and lower hook to pivot the pivot platform relative to the platform member.

4. An apparatus as set forth in claim 3 wherein the second platform includes a "U" shaped wall defined by a predetermined height, the "U" shaped wall including an elastomeric member laminated therewithin to receive the rifle therewithin.

5. An apparatus as set forth in claim 4 further including a first rail and a second rail, the first rail and second rail aligned parallel to one another and secured at a forward end of the first rail and the second rail to the first platform, and the first rail and second rail including a series of blind bores formed through an upper surface of the first rail and second rail, and the second platform including plural pairs of pegs receivable within the blind bores, wherein the second platform is adjustably mounted relative to the first platform upon positioning the pegs within selective blind bores of the first and second rails.

6. An apparatus as set forth in claim 5 further including an elastomeric insert defined by a generally "T" shaped cross-sectional configuration, with a recessed wall defined by a predetermined height equal to the predetermined height of the "U" shaped wall of the second support member, and the elastomeric insert including a cavity therewithin to receive the rifle.

7. An apparatus as set forth in claim 6 wherein the peg members include a first pair of pegs, wherein the first pair of pegs are positioned at a forward edge of the second platform integrally and orthogonally mounted to the bottom surface of the second platform, and spaced apart a distance equal to a spacing defined by the first and second rails, and a second pair of peg members positioned adjacent a rear edge of the second platform and integrally and orthogonally mounted to a bottom surface of the second platform and spaced apart a distance equal to a spacing defined by the first and second rail.

* * * * *